United States Patent [19]

Roberts et al.

[11] Patent Number: 4,955,816

[45] Date of Patent: Sep. 11, 1990

[54] ELECTRICAL CONNECTOR SYSTEM AND INSULATION DISPLACEMENT TERMINALS THEREFOR

[75] Inventors: James T. Roberts, Oak Park; Raymond A. Silbernagel, Naperville, both of Ill.

[73] Assignee: Molex Incorporated, Lisle, Ill.

[21] Appl. No.: 340,635

[22] Filed: Apr. 20, 1989

[51] Int. Cl.[5] ..... H01R 4/24

[52] U.S. Cl. ..... 439/421; 439/424; 439/358; 439/557

[58] Field of Search ..... 439/472, 478, 449, 389–407, 439/417–419, 421–424, 557, 427, 877, 879, 880, 882, 358

[56] References Cited

U.S. PATENT DOCUMENTS

| | | | |
|---|---|---|---|
| 4,445,748 | 5/1984 | Evans | 439/271 |
| 4,512,619 | 4/1985 | Dechelette | 439/276 |
| 4,522,468 | 6/1985 | Beck, Jr. et al. | 439/421 |
| 4,708,662 | 11/1987 | Klein | 439/472 |
| 4,713,021 | 12/1987 | Kobler | 439/272 |

*Primary Examiner*—David Pirlot

*Attorney, Agent, or Firm*—Louis A. Hecht; Stephen Z. Weiss

[57] ABSTRACT

An electrical connector system includes self-terminating pin and socket terminals which have forward mating ends and identical rearward wire receiving ends. The wire receiving ends are mountable in a modular rear housing. The modular rear housing is mateable with either a front plug housing or a front receptacle housing. The terminals can be mass terminated by inserting a plurality of wires into the modular rear housing and by axially advancing the modular rear housing toward the front housing component of the system. The housing components can be readily separated from one another for repair or replacement of terminals. Selected connectors may be lockingly mountable to panels and may be lockingly mateable with one another.

10 Claims, 11 Drawing Sheets

FIG.3
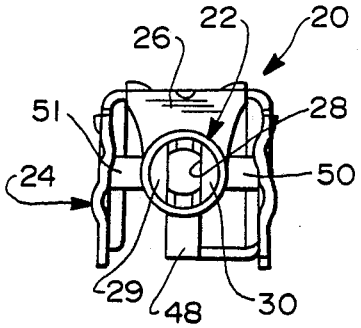
FIG.4
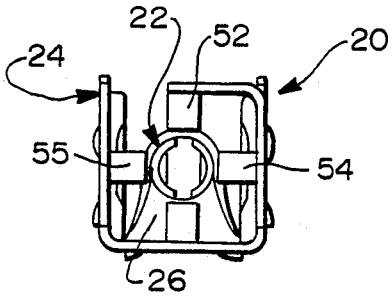
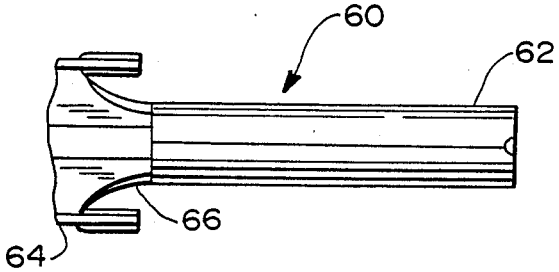
FIG.5

ELECTRICAL CONNECTOR SYSTEM AND INSULATION DISPLACEMENT TERMINALS THEREFOR

BACKGROUND OF THE INVENTION

Electrical connectors comprise nonconductive housings having at least one electrically conductive terminal mounted therein. Each terminal comprises a mating end constructed to enable electrical connection with the mating end of another terminal The opposed end of each terminal defines a conductor engaging end which is constructed to electrically and mechanically connect to a conductive lead in a wire, cable or the like. Mateable male and female terminals typically are mounted in dedicated receptacle and plug housings respectively. The housings may perform many functions, including protecting and positioning the terminals, guiding the terminals into a mated condition and/or locking the connectors in a mated condition.

Electrical connectors have been miniaturized drastically in recent years to conform with the corresponding miniaturization of circuits and electrical components. Despite the smaller dimensions, it is necessary for connectors to consistently provide high quality electrical connections and to ensure sufficient strain relief for preventing unintended separation of the wires from the terminals and connector housings.

The electronics industry is extremely competitive, and even small improvements in performance, cost or ease of assembly and disassembly can be very significant. There is of a course a logical and direct connection between the ease of assembly and disassembly and the total labor cost of a product. Furthermore, an easily assemblable product is not likely to be assembled improperly.

Some electrically conductive terminals can achieve assembly efficiency by avoiding the need to strip insulation from the end of a wire and crimp the terminal thereto. In particular, insulation displacement terminals (ID terminals) include insulation displacement structures for piercing and/or displacing the insulation on a wire to enable the terminal to achieve appropriate electrical connection with the electrically conductive leads of the wire. The typical ID terminal comprises a slot defined by opposed blades The insulated wire is advanced axially into an appropriate location aligned with the slot, and then is advanced transversely into the slot. The transverse movement of the wire into the slot enables the blades of the terminal to displace the insulation and make electrical connection with the conductors in the wire.

An extremely effective prior art ID terminal is shown in U.S. Pat. No. 4,512,619 which issued to Helen Dechelette on Apr. 23, 1985 and which is assigned to the assignee of the subject invention. The disclosure of U.S. Pat. No. 4,512,619 is incorporated herein by reference. Briefly, the terminal of U.S. Pat. No. 4,512,619 comprises a collapsible conductor engaging end into which an insulated wire may be axially inserted A plurality of the terminals shown in U.S. Pat. No. 4,512,619 may be mounted in a housing. A corresponding plurality of insulated wires are then axially advanced into the conductor engaging ends of the respective terminals. The wires may be mass terminated with the help of application tooling which causes specified locations on the terminals to collapse inwardly The collapsed portions of the terminals displace the insulation on the wires sufficiently to achieve high quality electrical connection with the conductors in the respective wires.

Electrical connectors must avoid placing excessive strain on the critical connection between the conductor of the wire and the terminal. Superior strain relief protection is particularly important for ID terminals. It is also important to ensure that the terminals are positively positioned and retained in the associated housing. This can be achieved with a two-part housing comprising a front mating portion and a rear cover which may be lockingly retained to one another with the terminals securely disposed therebetween. Two-part housings conceivably could result in assembly errors and inefficiencies. Therefore it is known to provide two-part housings having a pre-load position that permits the insertion of terminals therein, and a second locked position that lockingly retains the terminals and assures proper positioning. The two-part housing may be sold as an assembly in the pre-load position The purchaser may then insert the terminals and leads into the two-part housing and urge the housing components into their fully seated position to lockingly retain the terminals and assure proper terminal positioning.

One such two-part connector assembly is shown in U.S. Pat. No. 4,708,662 which issued to Klein on Nov. 24, 1987. The connector shown in U.S. Pat. No. 4,708,662 includes crimpable terminals that are crimped to the respective stripped wire leads prior to insertion into a housing. The connector shown in U.S. Pat. No. 4,708,662 includes a housing having an outer wall spaced from the remainder of the housing to define an envelope for receiving a deflectable latch arm of a terminal retainer. The inside of the envelope is characterized by two spaced apart latching bosses The first latching boss extends inwardly from the outer wall of the envelope, while the second latching boss extends outwardly from the inner wall of the envelope The outwardly extending latch boss is disposed and dimensioned to urge the latch arm of the terminal retainer outwardly for engagement with the forward edge of the outer wall This complex structure makes it extremely difficult to separate the housing components from one another Such separation often is required if it is determined that one or more terminals is not properly connected to its insulated lead or is somehow damaged during assembly or use.

The housings of most electrical connectors are injection molded in complex molding processes requiring expensive injection molds. It is desirable, wherever possible, to provide connector housing that will minimize the number of distinct molded components. This reduces the number of molds needed and can simplify inventory control.

In view of the above, it is an object of the subject invention to provide an electrical connector assembly for insulation displacement terminals.

It is another object of the subject invention to provide an electrical connector assembly having a forward housing portion and a rear housing portion that are lockably engageable with one another and that are easily separable from one another.

Another object of the subject invention is to provide a system of electrical connectors that minimizes the number of distinct components and that facilitates inventory control.

An additional object of the subject invention is to provide an improved insulation displacement terminal A further object of the subject invention is to provide an insulation displacement terminal having enhanced strain relief capabilities.

Still a further object of the subject invention is to provide an insulation displacement terminal having enhanced strength and an efficient and strong transition from a rectangular rearward wire engaging portion to a cylindrical forward mating portion.

SUMMARY OF THE INVENTION

The subject invention is directed to an electrical connector system and to different components of the system as explained herein. The system comprises a front housing for a plug connector, a front housing for a receptacle connector, a modular rear housing which is mateable with either of the front housings, self-terminating male terminals and self-terminating female terminals. The terminals may comprise collapsible insulation displacement contact sections to achieve electrical contact with conductors in insulated and unstripped wires.

Each terminal of the system may comprise a forward mating end and a rearward wire receiving end. The rearward wire receiving end may be constructed to receive a wire axially advanced therein. The collapsible insulation displacement contact sections preferably are disposed on the rearward wire receiving end of the terminals and are collapsible in response to axial forces exerted on the terminals. The axial forces exerted on the terminals may be applied simultaneously to a plurality of terminals to enable mass termination.

The wire receiving end of each terminal preferably comprises strain relief means for ensuring locking engagement of the terminals with the insulation on the respective wires for preventing rearward pull-out and separation of the wires relative to the terminals and the connector housing The strain relief structures may be defined by deflectable cantilevered beams extending into the wire receiving portion of each terminal The rearward wire receiving portion of each terminal may be of polygonal cross section The forward mating end of each terminal, on the other hand, may be of generally circular cross section to define either a pin terminal or a pin receiving socket terminal. Portions of each terminal between the polygonal cross sectioned wire receiving end and the circular cross section mating end may define at least one nonplanar gusset wall for enhancing the strength of the terminal at the transition between the mating end and the wire receiving end.

The modular rear housing may be mountable to the front housing for the plug connector or to the front housing for the receptacle connector in either of a first position or second position thereon. The relative locking positions between the modular rear housing and the appropriate front housing may be achieved by locking means which is readily releasable to enable the housing components to be selectively moved between the two positions and to be selectively and completely disengaged to enable separation of the modular rear housing from the appropriate front housing. The locking means may comprise deflectable latches on the respective front housing members. Each latch may comprise an outwardly extending locking member. The modular rear housing may comprise a bridging wall having inwardly extending first and second bosses. The bosses may have ramped leading faces to enable the inward deflection of the latch arms as the front and rear housings are urged toward one another. At least one boss may further comprise a rearwardly facing locking surface for lockingly but releasably engaging the front and rear housings together.

The rearward wire receiving end of each terminal may be slidably insertable into the modular rear housing of the connector. Typically a plurality of such terminals will be slidably inserted into separate terminal receiving cavities in the modular rear housing The forward mating end of each terminal similarly may be slidably insertable into the appropriate front housing In particular, the appropriate front housing may be mounted to the modular rear housing and over the mating ends of the corresponding terminals mounted in the modular rear housing.

The mounting of appropriate front housing to the modular rear housing in the first position will define an assembly of components comprising the modular rear housing, a plurality of terminals and the appropriate front housing. This assembly may be shipped and/or stored for subsequent connection to a plurality of unstripped wires. In particular, wires may be axially advanced into the rearward end of the rear housing such that each wire enters a terminal receiving cavity in the rear housing and is advanced axially into the rearward wire receiving end of the respective terminal. Strain relief means preferably is provided to prevent axial pull-out of the wires from the corresponding terminals. After the wires have been properly inserted into the rearward wire receiving ends of the terminals, the modular rear housing and the appropriate front housing may be axially advanced toward one another, with the aid of appropriate tooling to mass terminate the terminals to the wire leads. In particular, the axial advancement of the appropriate front housing toward the modular rear housing will urge the latch arms or other such connecting means into the second mounting position. This axial movement will cause the collapsible insulation displacement contact sections of the terminals to collapse and displace the insulation on the respective wires, thereby enabling contact with the conductive leads therein.

The connector may be selectively and easily disassembled by field personnel to replace a damaged or improperly mated terminal. In particular, the latches of the front housing may be urged inwardly and toward one another to readily clear the outwardly disposed and inwardly directed bosses on the modular rear housing. The modular rear housing and the appropriate front housing may be reassembled after the problem with the terminal has been corrected.

BRIEF DESCRIPTION OF THE DRAWINGS

FIG. 3 is an end view showing the mating end of the pin terminals of FIGS. 1 and 2.

FIG. 4 is an end elevational view showing the end of the pin terminal opposite that of FIG. 3.

FIG. 5 is a top plan view of the mating end of a socket terminal in accordance with the subject invention.

DETAILED DESCRIPTION OF THE PREFERRED EMBODIMENTS

Figure 1:
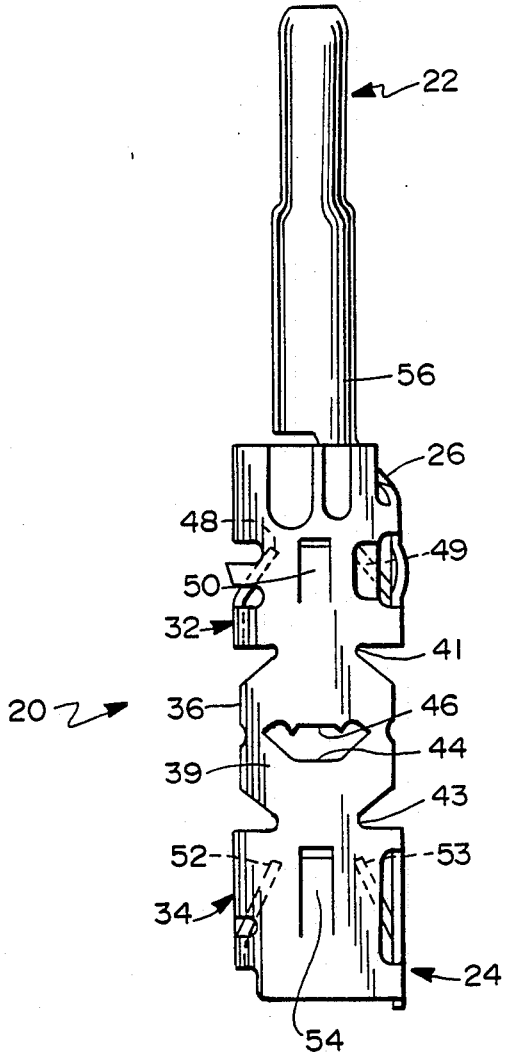
FIG. 1 is a side elevational view of a pin terminal in accordance with the subject invention.

The pin terminal for incorporation into the electrical connector system of the subject invention is identified generally by the numeral 20 in FIGS. 1–4. The pin terminal 20 is stamped and formed from a unitary piece of metallic material, and preferably a copper base alloy of approximately 0.012 inch thickness. The pin terminal 20 comprises a forward generally cylindrical mating end 22, a rear wire receiving end 24 and an intermediate nonplanar gusseted transition 26 extending therebetween. The mating end 22 is characterized by a longitudinally extending slit 28 defining a pair of inwardly deflectable pin contact arms 29 and 30 which are of generally semicylindrical configuration with arcuate leading ends to facilitate alignment and deflection during mating. The inward defelectability of the semicylindrical contact beams 29 and 30 help assure high normal contact forces and a quality electrical connection of the pin terminal 20 with a corresponding pin receiving socket terminal as explained below.

The rear wire receiving end 24 of the pin terminal 20 is of generally rectangular box-shaped cross-sectional configuration and comprises a forward wire receiving portion 32, a rearward wire receiving portion 34 and an intermediate collapsible contact section 36. The contact section 36 is defined by a pair of opposed collapsible contact walls 38 and 39 which are pre-formed in inward directions to ensure inward collapsing in response to axial forces exerted on the wire receiving end. The inward collapsing is facilitated by the reduced width portions 40 and 42 on the opposed ends of the collapsible wall 38 and the reduced width portions 41 and 43 on the opposed ends of the collapsible wall 39. The collapsible walls 38 and 39 are further characterized by polygonal apertures 44. The forward edge 46 of each aperture 44 is configured to displace the insulation on the wire inserted into the terminal 20.

Figure 2:
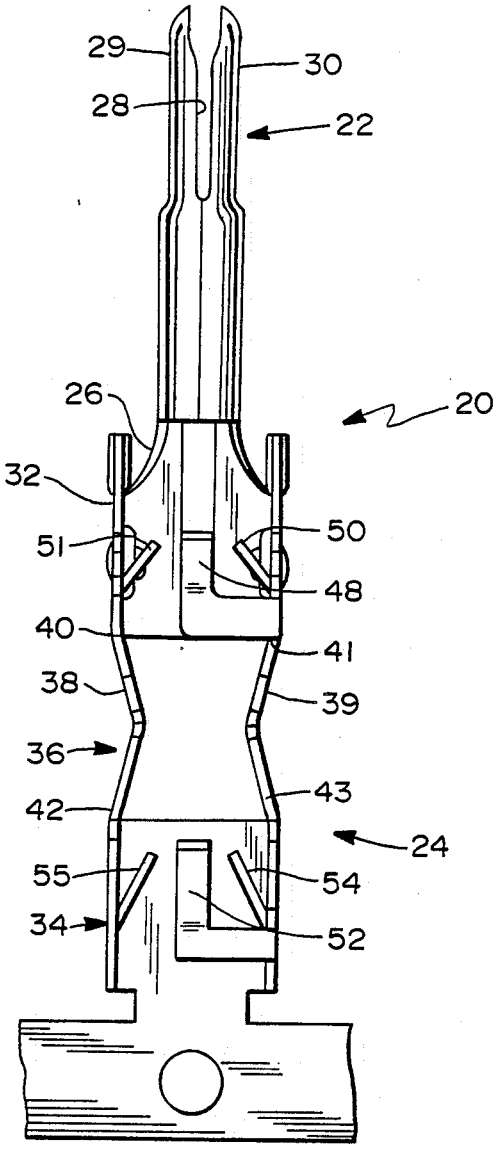
FIG. 2 is a top plan view of the pin terminal shown in FIG. 1.

As shown most clearly in FIG. 2, the terminal 20 does not include transverse walls in the longitudinal section defining the collapsible contact section 36 thereof. Rather, the generally rectangular front wire receiving portion 32 and the generally rectangular rear wire receiving portion 34 are connected only by the two spaced apart collapsible walls 38 and 39 defining the collapsible contact section. In view of this construction, axial forces exerted on the opposed ends of the wire receiving portion 24 of the terminal 20 will cause an inward collapsing of the inwardly formed walls 38 and 39. As explained in greater in detail in U.S. Pat. No. 4,512,619, the inward collapsing is carefully controlled and located to define pivoting about the reduced width sections 40–43, and further to define pivoting about a line extending transversely through the apertures 44. The inward collapsing caused by the axial forces exerted on the wire receiving end 24 of the terminal 20 will cause the edge 46 to pierce through and displace the insulation on the wire to achieve electrical connection with the conductors therein. The configuration and dimensions of the edge 46 of the polygonal aperture 44 is selected to ensure high quality contact with the conductors in the wire.

As noted above, strain relief of the electrical connectors is essential to prevent rearward forces on a wire from affecting the quality of the electrical connection between the wire and the terminal. In the subject connector system which provides mass terminatable insulation displacement terminals, it is also extremely desirable to ensure that the wires are fully seated prior to termination and are not inadvertently withdrawn in the interim. between the full seating and the mass termination. To ensure secure seating of the wire prior to termination and to provide the necessary strain relief, the subject terminal 20 is provided with forward and rearward arrays of resilient cantilevered fingers. In particular, a total of four forward fingers 48–51 are cantilevered to extend inwardly and forwardly from the forward end 32 of the wire engaging portion 24 of terminal 20. The length and angular alignment of the forward fingers 48–51 initially prevents deflection and associated forward movement of the wire into the wire receiving portion 24. Thus, the forward fingers function as wire stops which initially control the depth of wire insertion. As will be explained below, the wire will be urged past the forward fingers during termination, at which time the forward fingers will contribute to strain relief. The rearward fingers 52–55 are cantilevered from the rearward portion 34 of the wire receiving end 24 of terminal 20 and are separated by about 90°. The rearward fingers 52–55 also are cantilevered to extend forwardly and into the wire receiving portion 24. The rearward fingers 52–55 are aligned at a smaller angle to the side wall and readily deflect in response to the forward insertion of the wire into the terminal 20. Thus, the rearward fingers will grippingly engage the insulation on the wire to prevent rearward withdrawal of the wire both prior to and subsequent to termination. The provision of two axially spaced sets of fingers with the fingers in each set being spaced by 90° ensures proper axial positioning of the wire and exceptional strain relief both before and after termination.

The gusset wall 26 of the terminal 20 is of nonplanar tapered shape and defines a transition from the relatively large rectangular cross sectioned wire receiving portion 24 to the relatively small circular cross sectioned mating end 22. The gusset wall 26 begins rearwardly of the forward most end of the wire receiving portion, and extends arcuately into a generally cylindrical arch of at least approximately 90°. The transition in the gusset wall 26 from the generally planar rectilinear wall of the wire receiving end 24 into the arcuate configuration adjacent the mating end 22 provides for a rigid interconnection between the mating end 22 and the wire receiving end 24. The strength and rigidity of this interconnection is further enhanced by an inwardly extending embossment 56 extending the entire length of the gusset wall 26 and partly into both the mating end 22 and the wire receiving end 24. The gusset wall 26 achieves the reduction in cross-sectional dimension between the wire receiving end 24 and the mating end 22.

As best seen in FIG. 5, the electrical connector system of the subject invention further comprises a socket terminal 60 comprising a forward mating end 62, a rearward wire receiving end 64 and a gusset wall 66 extending therebetween. The forward wire receiving end 62 defines a cylinder dimensioned to receive the forward mating end 22 of the pin terminal 20 therein. The internal diameter of the end 62 of the socket terminal 60 is selected to ensure inward deflection of the contact beams 29 and 30 of the mating end 22 on the pin terminal 20. Thus, the movement of the mating end 22 of the pin terminal 20 into the mating end 62 of the socket terminal 60 will cause longitudinal wiping of the mating surfaces and inward deflection of the contact beams 29 and 30 to achieve high normal contact forces therebetween with a resulting quality electrical connection. The rear wire receiving end 64 of the socket terminal 60 is substantially identical to the rear wire receiving end 24 of the pin terminal 20 as described and illustrated in greater detail above. The gusset wall 66 is structurally and functionally similar to the gusset wall 26 on the pin terminal 20, which also is described and illustrated in greater detail above.

Figure 6:
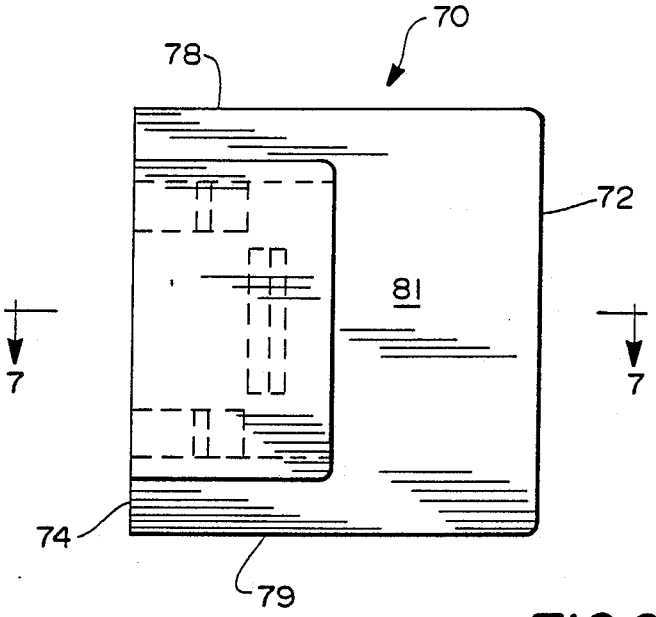
FIG. 6 is a side elevational view of the modular rear housing of the subject invention.
Figure 7:
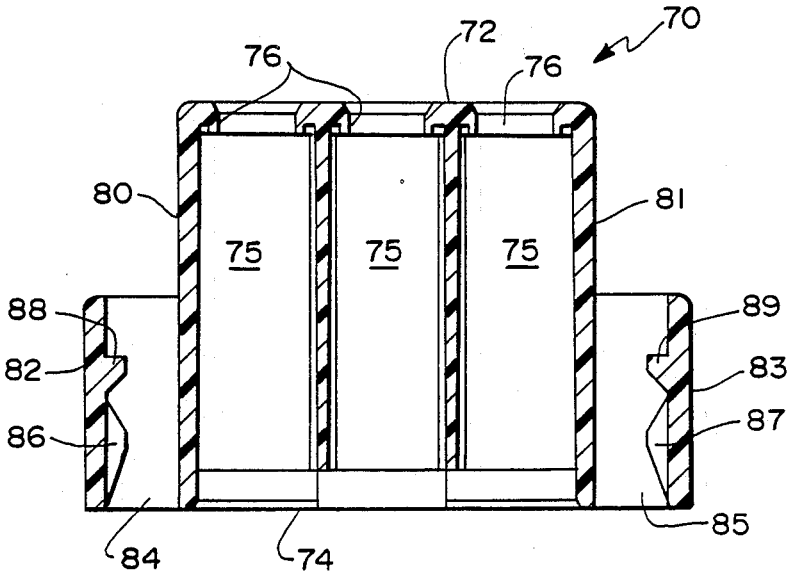
FIG. 7 is a cross-sectional view taken along line 7—7 in FIG. 6.

With reference to FIGS. 6 and 7, the electrical connector system of the subject invention further comprises a modular rear housing 70 which is unitarily molded from a plastic material and preferably a glass filled polyester. The modular rear housing 70 is a generally rectilinear structure having a rear wire receiving end 72 and a forward mating end 74. A plurality of substantially identical terminal receiving cavities 75 extend between the forward and rear ends 72 and 74 of the modular rear housing 70. The terminal cavities 75 are of generally rectangular cross section and are dimensioned to receive the rearward wire receiving ends 24, 64 of the pin or socket terminals 20, 60. The rearward end of each terminal cavity 75 defines a wire receiving aperture 76 having a tapered entry to facilitate insertion of a wire therein.

The modular rear housing 70 further comprises opposed top and bottom walls 78 and 79 and opposed side walls 80 and 81 as shown best in FIGS. 6 and 7. Bridging walls 82 and 83 are supported in spaced relationship to the respective side walls 80 and 81 to define latch receiving envelopes 84 and 85 therebetween. The bridging walls 82 and 83 are characterized by forwardly disposed inwardly extending first bosses 86 and 87 respectively and rearwardly disposed inwardly extending second bosses 88 and 89 respectively. The forwardly disposed first bosses 86 and 87 are substantially in line with one another and extend toward one another and toward the associated side walls 80 and 81 of the modular rear housing 70. The rearwardly disposed locking bosses 88 and 89 also are generally in line with one another and extend toward one another and toward the associated side walls 80 and 81. As shown most clearly in FIG. 7, the external surfaces of the side walls 80 and 81 extending through the latch receiving envelopes 84 and 85 are substantially planar and free of bosses or other surface irregularities. As will be explained further below, this planar configuration of the external surfaces of the side walls 80 and 81 facilitates the mounting and selective removal of the modular rear housing 70 with other housing components of the electrical connector system of the subject invention. The forwardly facing surfaces of the bosses 86–89 all are ramped to facilitate deflection of corresponding latching structures which are engageable with the bosses 86–89. The rearwardly facing surface of the rear bosses 88 and 89 extend generally orthogonal to the bridging walls 82 and 83 respectively to define locking surfaces for securely engaging corresponding latch structures as explained herein.

Figure 8:
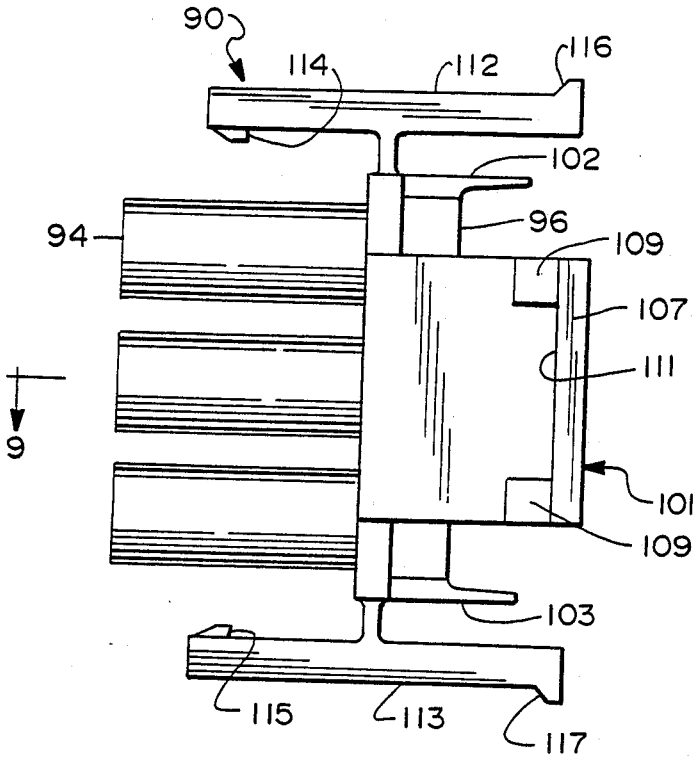
FIG. 8 is a side elevational view of the front housing for a plug connector in accordance with the subject invention.
Figure 9:
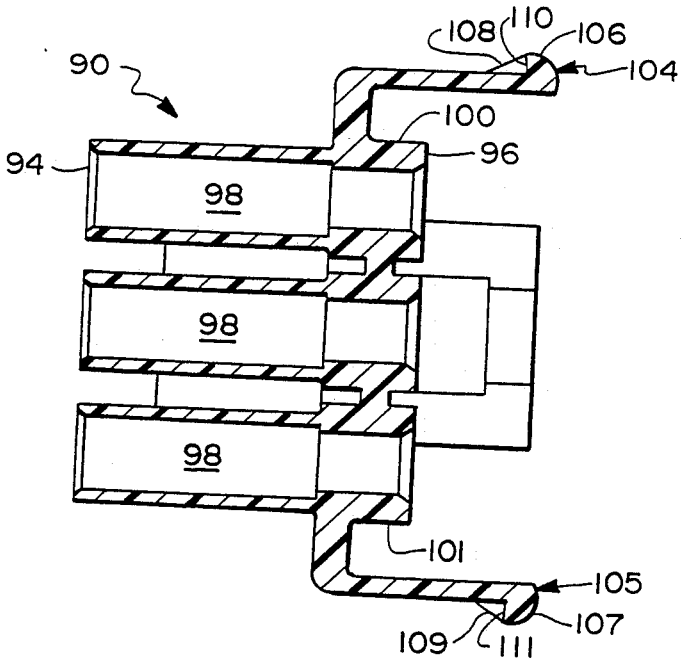
FIG. 9 is a cross-sectional view taken along line 9—9 in FIG. 8.
Figure 10:
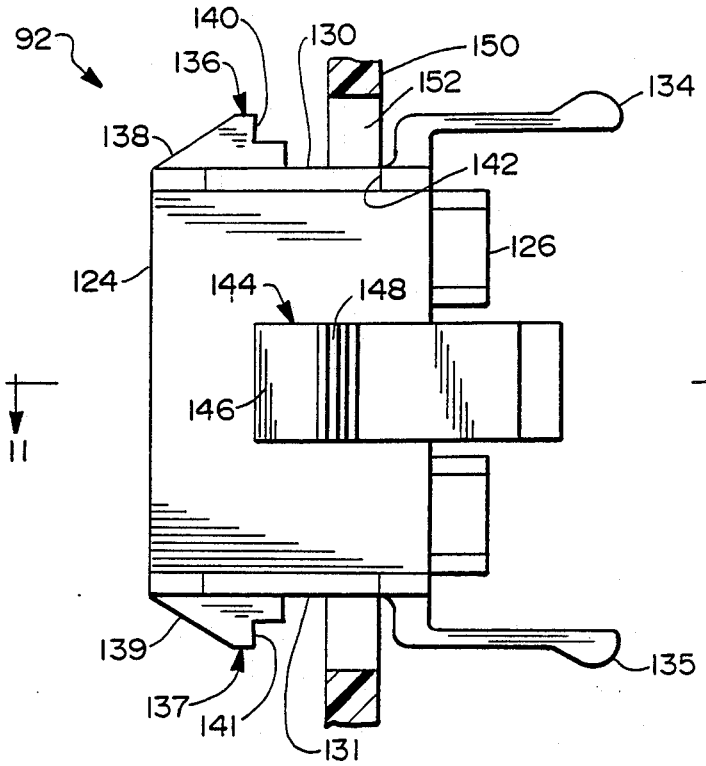
FIG. 10 is a top elevational view of the front housing for receptacle connector in accordance with the subject invention.
Figure 11:
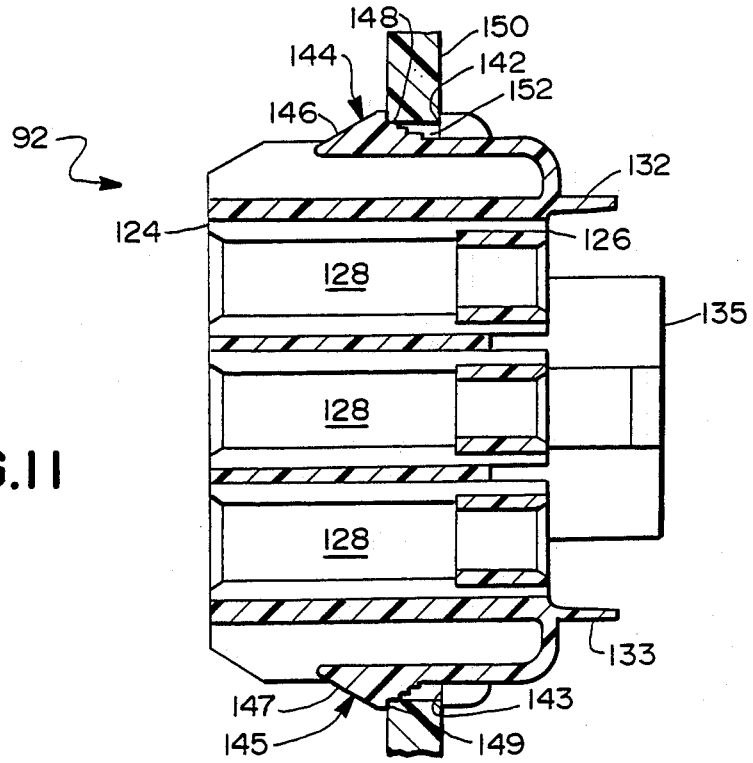
FIG. 11 is a cross-sectional view taken along line 11—11 in FIG. 10.
Figure 12:
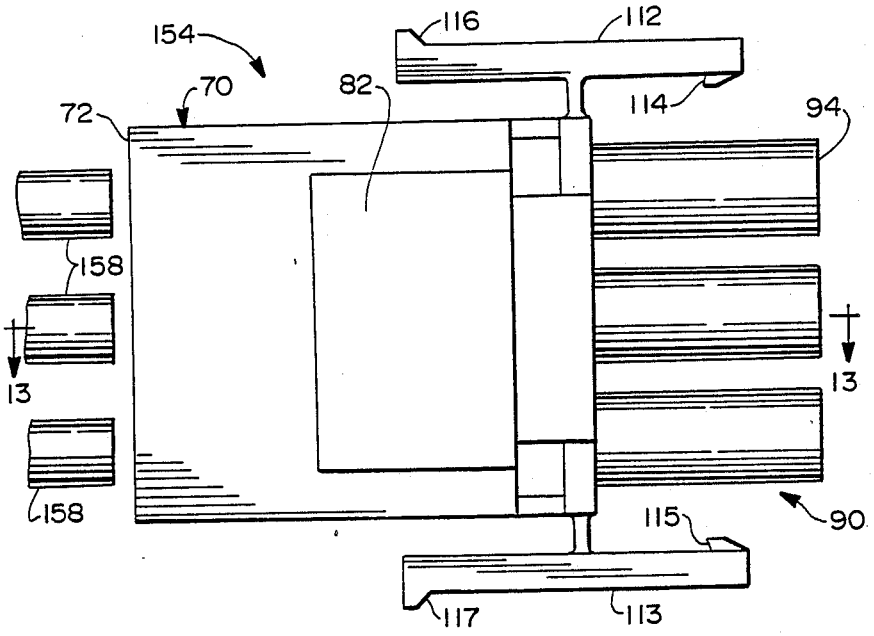
FIG. 12 is a top plan view of a plug connector prior to collapsing of the terminals.
Figure 15:
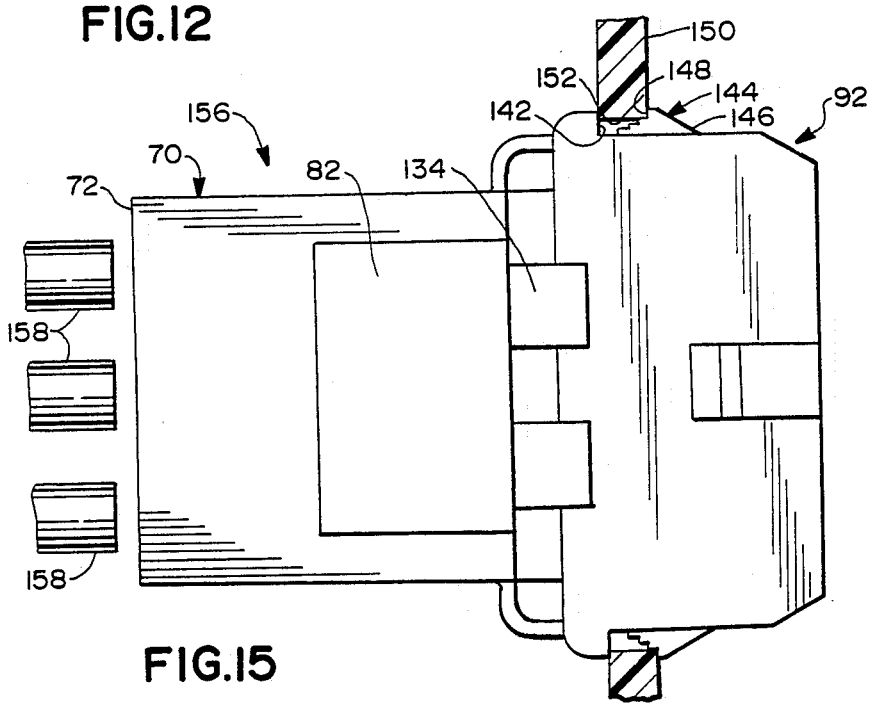
FIG. 15 is a top plan view of a receptacle connector prior to collapsing of the terminals.
Figure 13:
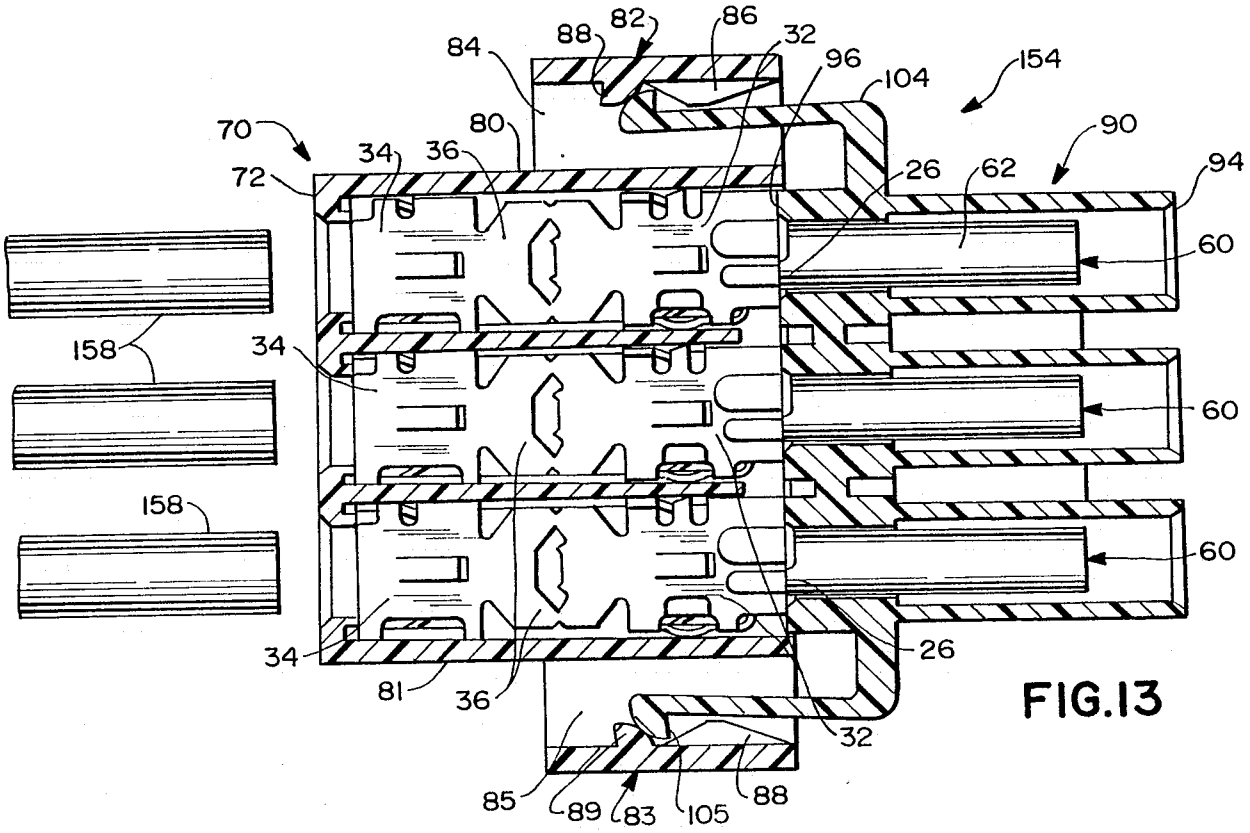
FIG. 13 is a cross-sectional view taken along line 13—13 in FIG. 12.
Figure 14:
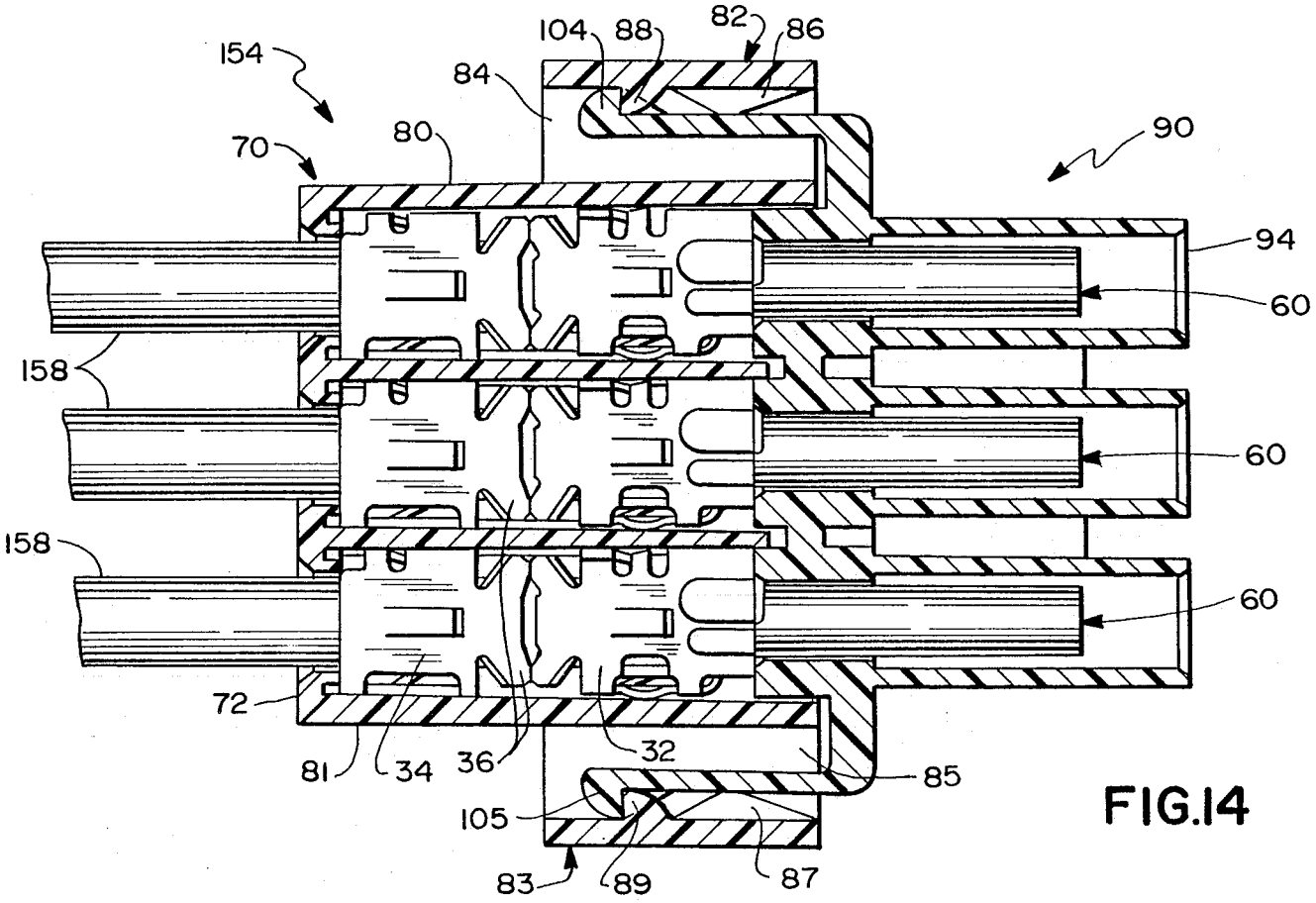
FIG. 14 is a cross-sectional view similar to FIG. 13 but showing the connector subsequent to collapsing of the terminals to an array of wires.
Figure 16:
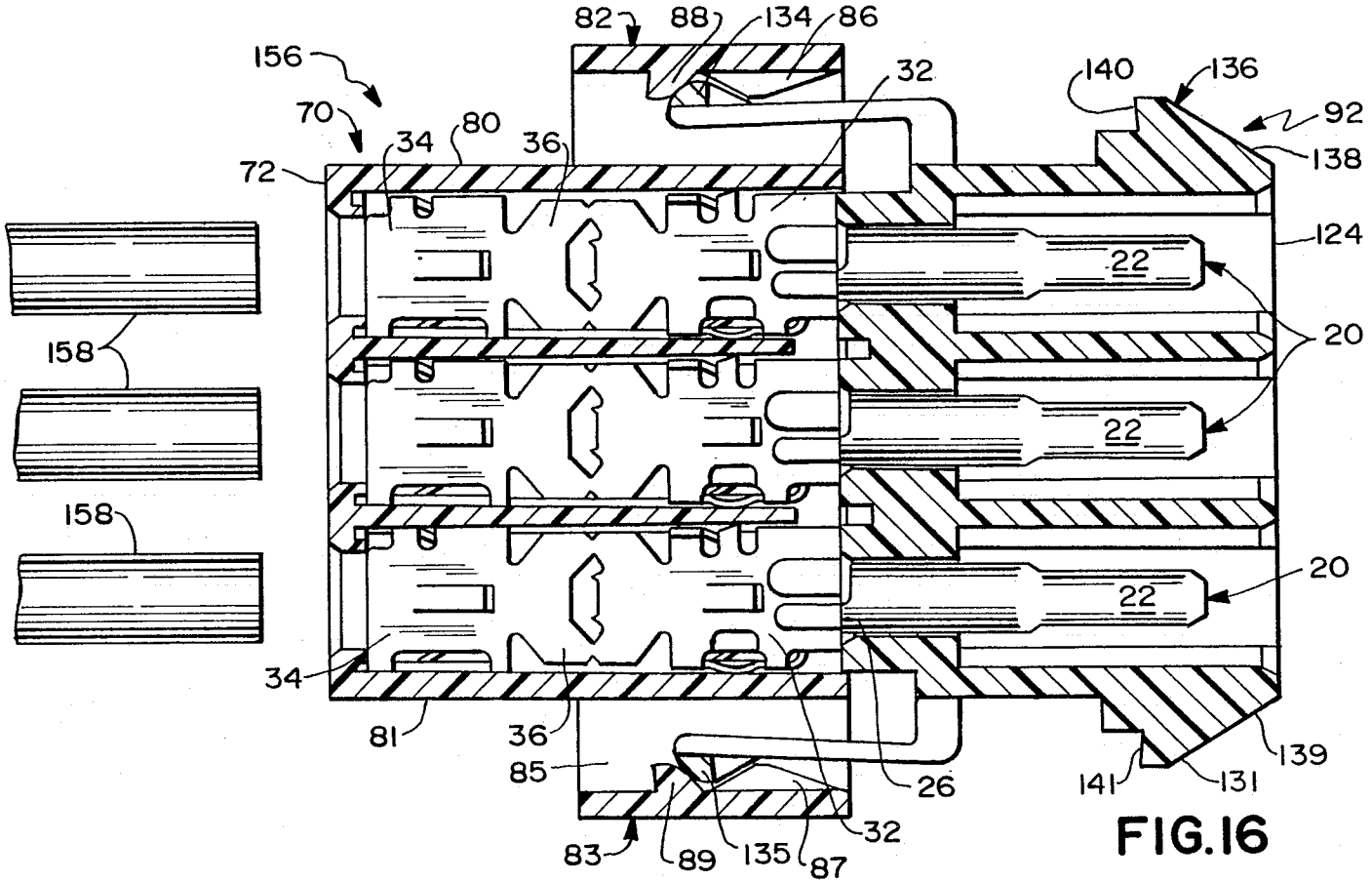
FIG. 16 is a cross-sectional view taken along line 16—16 in FIG. 15.
Figure 17:
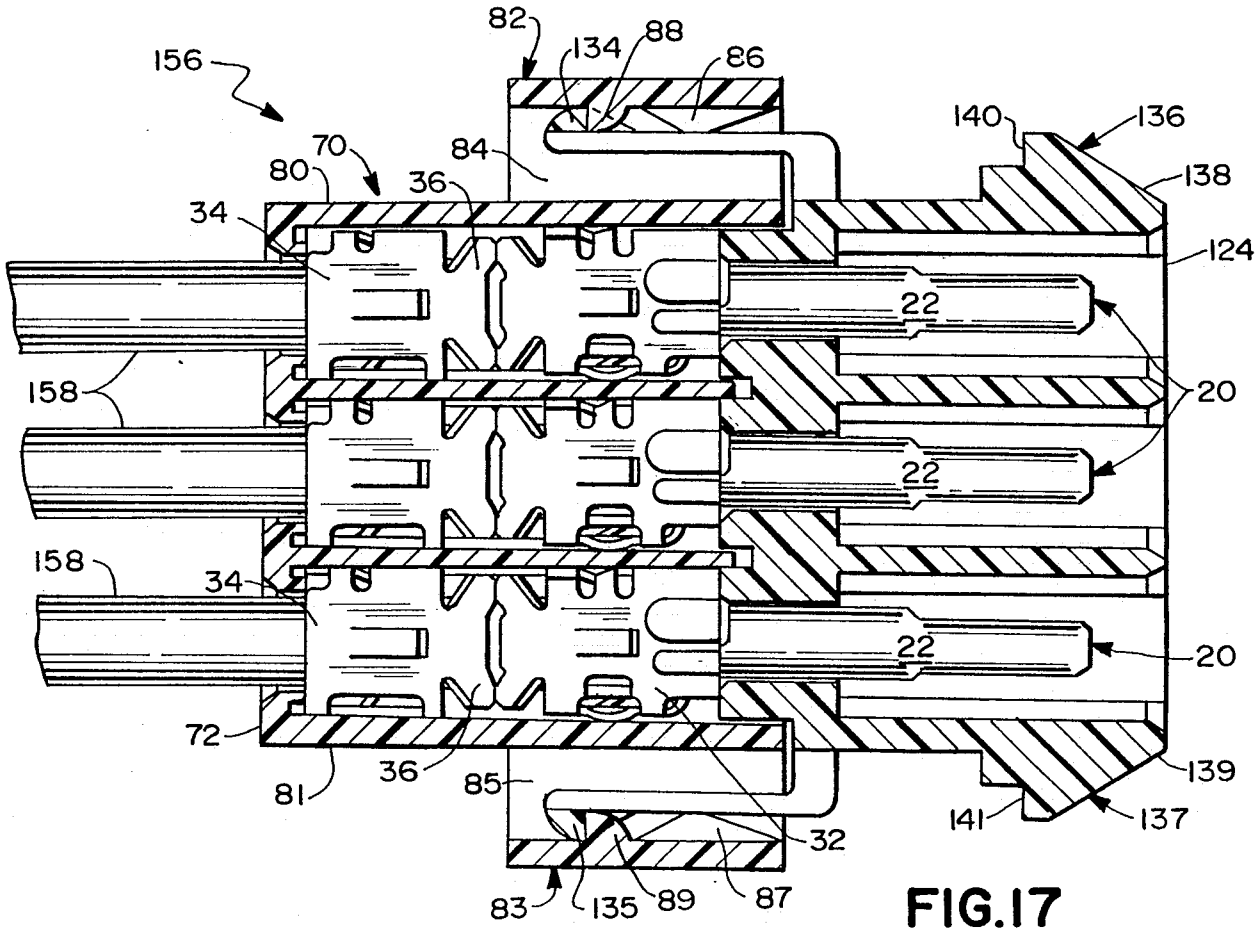
FIG. 17 is a cross-sectional view similar to FIG. 16 but showing the connector subsequent to collapsing of the terminals to an array of wires.

The connector system further comprises a front plug housing 90 as shown in FIGS. 8 and 9 and a front receptacle housing 92 as shown in FIGS. 10 and 11. As will be explained in greater detail herein, the modular rear housing 70 described and illustrated above is alternately mateable with either the front plug housing 90 shown in FIGS. 8 and 9 or the front receptacle housing 92 shown in FIGS. 10 and 11.

With reference to FIGS. 8 and 9, the front plug housing 90 comprises a forward mating end 94 and a rearward mounting end 96 which is lockingly mountable to the modular rear housing 70. A plurality of terminal receiving cavities 98 extend intermediate the forward and rearward ends 94 and 96 of the front plug housing 90. The terminal receiving cavities 98 are dimensioned to receive the mating ends 62 of the socket terminals 60, or mating ends 22 of pin terminals 20.

The front plug housing 90 comprises opposed side walls 100 and 101 which are spaced from one another to define an external width which enables the rear end 96 of the front plug housing 90 to be slidingly telescopingly inserted between the side walls 80 and 81 respectively of the modular rear housing 70 adjacent the forward end 74 thereof. Similarly, the front plug housing 90 comprises opposed top and bottom walls 102 and 103 which define an external height which enables the rear end 96 of the front plug housing 90 to be slideably inserted between the top and bottom walls 78 and 79 respectively of the modular rear housing 70 adjacent the forward end 74 thereof.

The front plug housing 90 is further characterized by rearwardly extending resiliently deflectable locking latches 104 and 105 which are cantilevered from the side walls 100 and 101 respectively at locations thereon spaced slightly from the rear end 96 of the front plug housing 90. The latches 104 and 105 comprise outwardly disposed leading ramp surfaces 106 and 107 respectively. The maximum external width defined between the leading ramp surfaces 106 and 107 substantially corresponds to the internal dimension between the inwardly facing surfaces of the bridging walls 82 and 83 rearwardly of the bosses 86–89 thereon.

The latches 104 and 105 further comprise rearwardly facing engagement surfaces 108 and 109 adjacent the top and bottom extremes of the latches 104 and 105 respectively for engaging the rearwardly facing inclined surfaces on the first bosses 86 and 87 of the modular rear housing 70. The latches 104 and 105 further comprise centrally disposed locking surfaces 110 and 111 extending orthogonal to the longitudinal axes of the front plug housing 90 for engaging the rearwardly facing locking surfaces of the second bosses 88 and 89. With this construction, the rearward end 96 of the front plug housing 90 may be urged toward the forward end 74 of the modular rear housing 70. This relative axial movement will cause the ramped leading surfaces 106 and 107 to engage the forwardly facing ramped surfaces of the first bosses 86 and 87 on the modular rear housing 70, thereby causing inward deflection of the latches 104 and 105. Sufficient axial movement of the front plug housing 90 and the modular rear housing 70 toward one another will cause the rearwardly facing engagement surfaces 108 and 109 on the deflectable latches 104 and 105 to engage the rearwardly facing inclined surfaces on the first bosses 86 and 87 respectively for mounting the front plug housing 90 in a first position relative to the modular rear housing 70. Further axial movement of front plug housing 90 toward the modular rear housing 70 will cause the leading ramp surfaces 106 and 107 of the latches 104 and 105 to engage the forwardly facing ramp surfaces of the second bosses 88 and 89, thereby causing a second inward deflection of the latches 104 and 105 respectively. Sufficient axial movement of the front plug housing 90 and the modular rear housing 70 toward one another will cause the rearwardly facing orthogonally aligned locking surfaces 110 and 111 of the latches 104 and 105 to engage the rearwardly facing locking surfaces of the second bosses 88 and 89 respectively. It will be appreciated that this locking engagement will prevent accidental separation of the modular rear housing 70 from the front plug housing 90. However, the substantially planar external configuration of the side walls 80 and 81 of the modular rear housing 70 will permit the latches 104 and 105 to be readily deflected inwardly toward one another and free of the bosses 86–89 on the modular rear housing. Thus, if necessary, the front plug housing 90 can be separated from the modular rear housing 70. As noted above, this separation typically would be carried out only to replace or repair a damaged terminal or an improperly terminated lead.

As shown most clearly in FIG. 8, the front plug housing 90 further comprises a pair of deflectable locking structures 112 and 113 which are cantilevered from the top walls 102 and 103 respectively. The locking structures 112 and 113 include forwardly disposed locking members 114 and 115 respectively which are disposed and dimensioned to engage corresponding locking structures on the forward end of a receptacle housing 92 as explained below. The locking structures 112 and 113 cantilevered from the front plug housing 90 further comprise rearwardly disposed actuators 116 and 117 which permit deflection of the locking structures 112 and 113 for disengaging the front plug housing 90 from a front receptacle housing 92 mated therewith.

Turning to FIGS. 10 and 11, the front receptacle housing 92 comprises a forward mating end 124 and a rear mounting end 126. A plurality of terminal cavities 128 extend between the forward and rear ends 124 and 126 and are dimensioned to receive the forward mating ends 22 or 62 of the pin or socket terminals 20 or 60 described and illustrated above.

The front receptacle housing 92 comprises a pair of opposed side walls 130 and 131 and a pair of opposed top and bottom walls 132 and 133 respectively. The external dimensions defined by the side walls 130 and 131 adjacent to the rear end 126 of the front receptacle housing 92 enables the rear end 126 to be slideably inserted between the side walls 80 and 81 respectively of the modular rear housing 70. Similarly, the external dimensions defined by the top and bottom walls 132 and 133 adjacent the rear end 126 of the front receptacle housing 92 enables the rear end 126 to be slideably inserted between the top and bottom walls 78 and 79 of the modular rear housing 70.

The front receptacle housing 92 further comprises rearwardly extending resilient deflectable latches 134 and 135 which are cantilevered from the side walls 130 and 131 respectively and which are substantially identical to the above described latches 104 and 105 on the front plug housing 90. The latches 134 and 135 enable the front receptacle housing 92 to be mounted to the modular rear housing 70 in each of two alternative mounting positions, as had been explained with respect to the front plug housing 90, and which will be explained further below.

The side walls 130 and 131 are further characterized by outwardly extending locking bosses 136 and 137 adjacent the forward mating end 124 of the front receptacle housing 92. The bosses 136 and 137 include forwardly facing ramped surfaces 138 and 139 respectively and rearwardly facing locking surfaces 140 and 141 respectively. The ramped surfaces 138 and 139 are configured to engage the leading ramped surfaces on the deflectable latches 112 and 113 on the front plug housing 90 described and illustrated above. The rearwardly facing locking surfaces 140 and 141 will lockingly engage the rearwardly facing locking surfaces 114 and 115 on the latches 112 and 113 to securely retain the front plug housing 90 and the front receptacle housing 92 in mated engagement.

As shown most clearly in FIG. 11, the front receptacle housing 92 further comprises forwardly facing stop walls 142 and 143 extending rigidly outwardly from the top and bottom walls 132 and 133 respectively. Forwardly directed panel latches 144 and 145 are deflectably and resiliently cantilevered from the top and bottom walls 132 and 133. In particular, the panel latches 144 and 145 extend from portions of the top and bottom walls 132 and 133 generally adjacent the rear end 126 of the front receptacle housing 92 and extend forwardly of the stop walls 142 and 143 respectively. The panel latches 144 and 145 comprise forwardly facing ramped walls 146 and 147 respectively and stepped rearwardly facing locking walls 148 and 149 respectively. The stop walls 142 and 143 and the panel latches 144 and 145 are constructed to securely engage the front receptacle housing 92 to a panel 150. In particular, the front receptacle housing 92 will be urged into an appropriate aperture 152 in a panel 150 causing the panel latches 144 and 145 to deflect inwardly. Sufficient movement of the front receptacle housing 92 into the panel aperture will cause the panel 150 to be engaged between the forwardly facing stop walls 142 and 143 and the rearwardly facing stepped locking walls 148 and 149. The particular portion of the rearwardly facing stepped locking walls 148 and 149 that will engage the panel 150 will depend upon the thickness of the panel 150.

The connector system described above is employed by initially placing the rearward ends 24 or 64 of pin or socket terminals 20 or 60 in a modular rear housing 70. In particular, the rearward ends 24 or 64 are urged into the corresponding terminal receiving cavities 75 of the modular rear housing 70. As noted above, the rearward ends 24 and 64 of the pin or socket terminals 20 or 60 are substantially identical to one another, and it is unnecessary to have distinct dedicated rear housings for each of the pin and socket terminals 20 and 60. In particular, a modular rear housing 70 may be employed with either of the plug terminals 20 or socket terminals 60.

After the rearward ends 24, 64 of the pin or socket terminals 20, 60 are mounted in the modular rear housing, the appropriate front housing is mounted thereto.

In particular, the modular rear housing 70 having the pin terminals 20 mounted therein may have the front receptacle housing 92 mounted thereto. The modular rear housing 70 having the socket terminals 60 mounted therein may have the front plug housing 90 mounted thereto. With each of these optional constructions, the rearward end 96 or 126 of the appropriate front housing 90 or 92 is telescoped into the forward end 74 of the modular rear housing 70. This telescoped movement of the front housing 90 or 92 into the modular rear housing 70 causes the forward mating end 22, 62 of the pin or socket terminal 20 or 60 to enter a terminal receiving cavity 128, 98 of the associated front receptacle housing or front plug housing 92 or 90 respectively. Additionally, the axial advancement of the modular rear housing 70 toward either the front receptacle housing 92 or the front plug housing 90 will cause the cantilevered deflectable latches 134, 135 or 104, 105 to slideably advance into the envelope 84, 85 defined between the bridging wall 82, 83 and the associated side walls 80, 81 of the modular rear housing 70. The rearwardly facing ramped face of the latches 134, 135 or 104, 105 will engage the forwardly facing ramp face of the first bosses 86, 87 on the bridging walls 82, 83 of the modular rear housing 70. Sufficient axial movement with corresponding inward deflection of the latches 134, 135 or 104, 105 will enable the forwardly facing ramped engagement surfaces on the latches 134, 135 or 104, 105 to engage the corresponding rearwardly facing ramped engagement surfaces of the first bosses 86 and 87. This will securely engage the front receptacle housing 92 or the front plug housing 90 in a first mounted position relative to the modular rear housing 70 with the plug or socket terminals 20, 60 securely engaged therein. This assembled but unterminated plug or receptacle connector 154 or 156, as shown in FIGS. 12, 13, 15 and 16, can be stored and/or shipped to a location for subsequent wire insertion and mass termination.

The plug or receptacle subassembly 154 or 156 is terminated by inserting wires 158 into the apertures 76 in the rear end 72 of the modular rear housing 70. Axial movement of the wires 158 will cause the wires 158 to be advanced into the wire receiving ends 24, 64 of the terminals 20, 60. The axial movement of the wires 158 will cause the rear cantilevered fingers 52–55 extending angularly into the wire receiving ends 24, 64 of the terminals 20, 60 to deflect outwardly to permit continued advancement of the wires 158. However, the angular alignment and forwardly extending orientation of the cantilevered fingers 52–55 will cause the fingers to grippingly engage the insulation on the wires 158 and prevent rearward withdrawal of the wires 158 from the modular rear housing 70. Axial movement is initially stopped by the forward fingers 48–51 which define greater angles to the side walls than the deflectable rear fingers 52–55.

After the wires 158 have been properly and fully inserted into the modular rear housing 70 and the rear wire receiving ends 24, 64 of the terminals 20, 60 mounted therein, the mass termination may be carried out. In particular, the modular rear housing 70 may be axially advanced relative to the appropriate front plug housing 90 or front receptacle housing 92. This relative axial movement may be achieved with appropriate application tooling. The axial advancement of the modular rear housing 70 relative to the front plug housing 90 or front receptacle housing 92 will cause the inward deflection of the latches 104, 105 or 134, 135 due to engagement with the forwardly facing ramped surfaces on the second bosses 88 and 89 respectively. Sufficient axial movement will cause the forwardly facing locking surfaces on the latches 104, 105 or 134, 135 to securely, lockingly engage the rearwardly facing locking surfaces on the second bosses 88 and 89 respectively. The axial movement of the modular rear housing 70 between the first and second positions relative to the front plug housing 90 or front receptacle housing 92 will effect a collapsing of the wire receiving ends 24 or 64 of the pin or socket terminals 20, 60. In particular, and as explained in greater detail in U.S. Pat. No. 4,512,619, the collapsing of the contact section 36 will cause the collapsible contact walls 38 and 39 to effectively fold inwardly such that the insulation displacement edges 46 on the polygonal aperture 44 thereof displace the insulation on the wires 158 and securely engage the conductors therein. The collapsing of the terminals 20, 60 will urge the end of each wire 158 forwardly with sufficient force to deflect the forward fingers 48–51. The forward fingers 48–51 will thus engage the insulation and contribute to strain relief. The locking engagement between the latches 104, 105 or 134, 135 with the second bosses 88, 89 on the modular rear housing 70 will securely hold the terminals 20, 60 in contacting engagement with the wires 158. It will be appreciated that the mass termination enabled by the subject electrical connector system merely requires axial movement of the components, and namely axial advancement of the terminals 20, 60 relative to the housing components 70, 90, 92 and axial advancement of the wires 158. Furthermore, this efficient axial advancement of the various components achieves a mass termination of all of the terminals and all of the wires in each connector simultaneously.

It may be desirable to initially or periodically test the electrical connections that have been made between the terminals 20, 60 and the wires 158. If it is determined that a connection is not complete or if it is determined that a terminal 20, 60 is damaged either during installation, storage or use, the subject connector system enables relatively easy repair or replacement. In particular, the front plug housing 90 or the front receptacle housing 92 can readily be disengaged from the modular rear housing 70 by merely urging the latches 104, 105 or 134, 135 inwardly and out of engagement with the bosses 86–89 on the modular rear housing 70. In particular, as shown in FIG. 7 and described above, the external surfaces of the side walls 80 and 81 are substantially smooth and planar and readily permit the inward deflection of the latches 104, 105 or 134, 135 to enable separation and appropriate repair if and when necessary.

The electrical receptacle connector 156 formed with the modular rear housing 70, the front receptacle housing 92 and the terminals 20 or 60 typically are mounted to a panel 150 having an appropriate aperture 152 therein. In particular, the connector 156 is urged forwardly into the aperture 152 in the panel 150, thereby causing the panel latches 144, 145 to be deflected inwardly such that the panel is engaged between the stop walls 142, 143 and the rearwardly facing stepped locking walls 148 and 149 of the deflectable panel latches 144, 145. In this condition, the modular rear housing 70 and the wires 158 extending therefrom will be disposed on one side of the panel. The forward end 124 of the front receptacle housing 92 will extend from the opposed side of the panel. The plug connector 154 which comprises a modular rear housing 70, a front plug housing 90 and a plurality of terminals 20 or 60 engaged therebetween is securely mountable to the panel mounted receptacle connector 156. In particular, the plug connector 154 is urged axially toward the receptacle connector 152 such that the forward ends of the mating latches 112 and 113 are deflected outwardly by the engagement with the forward ramped surfaces 138 and 139 on the front receptacle housing 92. Sufficient axial advancement of the plug connector 154 toward the panel will cause the locking surfaces 114 and 115 on the mating latches 112 and 113 to lockingly engage the locking surfaces 140 and 141 on the mating locks 136 and 137. Unmating can readily be achieved by merely urging the rearward ends 116 and 117 of the mating latches 112 and 113 toward one another, thereby causing the locking surfaces 114 and 115 to be deflected away from one another and out of engagement with the locking surfaces 140 and 141 on the front receptacle housing 92.

In summary, an electrical connector system is provided comprising collapsible self-terminating pin and socket terminals having mateable front ends and identical rearward wire receiving ends. The connector system further comprises a modular rear housing having terminal cavities for receiving the identical wire receiving ends of the pin and socket terminals. The system further comprises front plug housings and front receptacle housings either of which is mountable to the modular rear housing in alternate first and second positions thereon. The appropriate front plug housing or front receptacle housing is mounted to the modular rear housing in the first position and insulated wires are inserted into the modular rear housing and the wire receiving ends of the terminals therein. With the help of application tooling, the modular rear housing may be urged axially toward the front plug housing or front receptacle housing causing the contact portions of the terminals to be collapsed inwardly to displace the insulation on the wires and achieve electrical contact with the conductors therein. This axial advancement of the modular rear housing toward the front plug housing or front receptacle housing will lockingly retain the front and rear housing components in the second position relative to one another. The plug or receptacle connector can be disassembled readily by merely urging latching members of the front plug housing or front receptacle housing inwardly and out of engagement with the corresponding latching components on the modular rear housing. The receptacle housing further comprises panel latching members to enable secure mounting of the receptacle connector to a panel. Mating locking members also are provided for releasable but secure locking engagement of the plug connector with the panel-mounted receptacle connector.

While the invention has been described with respect to a preferred embodiment, it is apparent that various changes can be made without departing from the scope of the invention as defined by the appended claims. In particular, the terminals described and illustrated above are the preferred terminals, but other terminal constructions may be employed with the connector system. Alternatively, the preferred terminals may be employed with other housings. Furthermore, variations in the illustrated and described locking members can be made.

We claim:

1. An electrical connector system including:

a plurality of male terminals each having a forward mating end and a rearward wire mounting end;

a plurality of female terminals each having a forward mating end to mate with the forward mating end of the male terminal and having a rear wire mounting end substantially identical to said wire mounting end of the male terminals;

mating insulative receptacle housing means and plug housing means, each having a forward end, a rear end and at least one terminal receiving cavity extending therebetween, said cavities mounting at least one of said terminals therein;

the improvement comprising:

each of said receptacle and plug housing means including separate cooperating forward and rear housing members;

said forward receptacle and plug housing members each including said forward end, a rear mounting end having a first locking structure and at least a portion of said terminal receiving cavity extending therebetween to mount the forward mating ends of at least one of said female terminals and male terminals therein;

said rear receptacle and plug housing members each being substantially identical and including identical second locking structures cooperating with said first locking structure so that the identical rear housing members are modular and are interchangeably mountable to the rear mounting end of either forward housing member;

the rear wire mounting end of each said terminal comprises a forward wire engaging section, a rearward wire engaging section and a collapsible insulation displacement contact section disposed therebetween, said modular rear housing member being mounted for telescoping movement relative to said forward housing member for axially collapsing the insulation displacement contact sections into electrical contact with a wire inserted therein; and said modular rear housing member includes at least one wall having a generally planar external surface, at least one bridging wall disposed in spaced relationship to said planar surface and said second locking structure having first and second locking bosses extending from said bridging wall toward said generally planar surface, said first locking structure of the forward plug housing member having deflectable latches selectively and alternately engageable with the locking bosses extending from said bridging wall, whereby engagement of one of said latches with said first locking boss securely mounts a selected one of said front housing to said modular rear housing and retains at least one of the terminals therebetween, and whereby movement of the selected front housing into position for locking engagement of the latch with the second locking boss is operative to collapse the insulation displacement contact section of each said terminal therein.

2. A metallic stamped and formed collapsible insulation displacement terminal including:

a forward mating end; and a rear wire receiving end having a forward wire engaging section with a plurality of side walls for receiving an insulated wire therebetween, a rear wire engaging section with a plurality of side walls for receiving said wire therebetween and an axially collapsible insulation displacement section extending therebetween which electrically engages said wire when said terminal is axially compressed the improvement in said terminal including strain relief means comprising:

a plurality of cantilevered wire stop fingers extending forwardly from said walls of said forward wire engaging section toward said wire for limiting forward axial movement of the wire therein and a plurality of cantilevered strain relief fingers extending forwardly from said wall of said rear wire engaging section toward said wire for engaging the insulation thereon, whereby said cantilevered fingers cooperate to positively stop and securely engage the wire for preventing rearward movement of the wire both before and after the collapsing of the insulation displacement section.

3. An insulation displacement terminal as in claim 2 wherein the side walls of the forward and rearward wire engaging sections are of generally rectangular cross section, and wherein said terminal comprises a pair of generally parallel spaced apart insulation displacement contact walls extending between and connecting the forward and rearward wire engaging sections.

4. An insulation displacement terminal as in claim 3 wherein the rearward wire engaging section comprises four strain relief fingers for engaging the insulation of the wire at locations spaced approximately 90° thereabout.

5. An insulation displacement terminal as in claim 2 wherein the forward mating end of said terminal is of generally cylindrical configuration, and wherein the rearward wire receiving end is of generally rectangular cross section, said terminal further comprising a nonplanar gusset wall extending between and supporting the mating end and the wire receiving end relative to one another.

6. An insulation displacement terminal as in claim 2 wherein the forward mating end of said terminal defines a pin terminal.

7. An insulation displacement terminal as in claim 2 wherein the forward mating end of said terminal defines a socket terminal.

8. An electrical connector including:

at least one axially collapsible insulation displacement terminal having a forward mating end and a rearward wire mounting end with an insulation displacement section;

mating insulative housing means having a forward end, a rear end and at least one terminal receiving cavity extending therebetween for mounting said terminal therein;

the improvement in said connector comprising:

said housing means including separate cooperating first and second housing members, with said terminal receiving cavity extending therebetween to mount said terminal therein;

locking means for lockingly mounting said first and second housing members in alternate first and second relative positions; and said wire receiving end of each said terminal comprises a forward wire engaging section having a plurality of fingers cantilevered therefrom and defining a stop for limiting forward axial movement of the wire therein, a rearward wire engaging section having a plurality of deflectable strain relief fingers cantilevered therefrom for engaging a wire at a plurality of locations spaced thereabout, said inwardly collapsible contact wall being disposed intermediate the forward and rearward wire engaging portions, whereby the deflectable strain relief fingers are operative to securely engage a wire both prior to and after the inward collapsing of the insulation displacement contact wall of said terminal;

whereby said terminal is axially collapsible in response to the movement of said housing members from the first position to the second position so that the insulation displacement section electrically contacts a wire placed therein.

9. An electrical connector as in claim 8 wherein the locking means includes a bridging wall extending from said first housing member and having first and second bosses extending from said bridging wall toward the remainder of said first housing member, the second housing member including a deflectable latch alternately and selectively engageable with the first and second bosses, whereby the engagement of said latch with said first boss securely mounts said housing members in the first position, and whereby the engagement of said latch with said second boss securely engages the housing members in the second position.

10. An electrical connector as in claim 8 wherein the first housing member further includes a substantially planar wall opposite said bosses for facilitating deflection of said latch away from said bosses for separating said housing members.

* * * * *